United States Patent [19]

Wataya et al.

[11] Patent Number: 4,739,739

[45] Date of Patent: Apr. 26, 1988

[54] FUEL-INJECTION CONTROL SYSTEM FOR AN INTERNAL COMBUSTION ENGINE

[75] Inventors: Seiji Wataya; Yuji Kishimoto, both of Himeji, Japan

[73] Assignee: Mitsubishi Denki Kabushiki Kaisha, Japan

[21] Appl. No.: 30,504

[22] Filed: Mar. 27, 1987

[30] Foreign Application Priority Data

Mar. 31, 1986 [JP] Japan ..... 61-76140

[51] Int. Cl.[4] ..... F01B 25/08

[52] U.S. Cl. ..... 123/479; 123/588; 123/494

[58] Field of Search ..... 123/479, 494, 588

[56] References Cited

U.S. PATENT DOCUMENTS

| | | | |
|---|---|---|---|
| 3,834,361 | 9/1974 | Keely | 123/479 |
| 4,049,957 | 9/1977 | Kera | 123/479 |
| 4,133,323 | 1/1979 | Adler | 123/479 |
| 4,370,962 | 2/1983 | Hosaka | 123/479 |
| 4,409,929 | 10/1983 | Sasaki | 123/479 |
| 4,414,949 | 11/1983 | Honig | 123/479 |
| 4,424,785 | 1/1984 | Ishida | 123/479 |
| 4,641,619 | 2/1987 | Okimoto | 123/479 |

FOREIGN PATENT DOCUMENTS

| | | | |
|---|---|---|---|
| 59-18124 | 5/1984 | Japan | 123/479 |
| 60-18822 | 5/1985 | Japan | 123/479 |

*Primary Examiner*—Ronald B. Cox

*Attorney, Agent, or Firm*—Leydig, Voit & Mayer

[57] ABSTRACT

A fuel-injection control system for an internal combustion engine capable of ensuring the stable and proper backup operation of the engine in case of a failure of an intake-air sensor without suffering from any substantial influence from the amount of intake air flowing through a bypass conduit which bypasses a part of intake air in an intake passage across a throttle valve. The fuel-injection control system comprises: the intake-air sensor for detecting the flow rate or the pressure of intake air sucked into the engine; a throttle-opening sensor adapted to generate an output signal representative of the opening degree of the throttle valve; a temperature sensor adapted to generate an output signal representative of the temperature of an engine coolant; an engine RPM sensor adapted to generate an output signal representative of the RPMs of the engine; and a control unit adapted to receive output signals of the sensors for controlling the operations of the fuel injection valves on the basis of the information on engine operating conditions obtained from the sensors in a manner such that when the intake-air sensor fails, the amount of fuel to be injected from the fuel injection valves is determined on the basis of the opening degree of the throttle valve detected by the throttle-opening sensor, the temperature of the engine coolant detected by the temperature sensor, and the RPMs of the engine detected by the engine RPM sensor.

5 Claims, 5 Drawing Sheets

FUEL-INJECTION CONTROL SYSTEM FOR AN INTERNAL COMBUSTION ENGINE

BACKGROUND OF THE INVENTION

1. Field of the Invention

The present invention relates to a fuel-injection control system for an internal combustion engine, and more particularly, to such a fuel-injection control system which is adapted to enable an engine to operate in a proper manner under the action of a backup means when an intake-air sensor for detecting the loading condition of the engine has failed.

2. Description of the Prior Art

In the past, in order to improve the output power and emission control of automotive gasoline engines, many so-called electronically-controlled fuel injection systems have been widely developed and reduced into practice which have, as a major component, an electronic control device for controlling the opening time of a fuel injection valve(s), which is adapted to inject pressurized fuel into the engine, on the basis of the information obtained from an intake-air sensor for detecting the amount of intake air sucked into the engine, and other various sensors. In cases where the intake-air sensor, the most important of various components of such a fuel-injection system, has failed, the operation of the engine becomes impossible so that the vehicle equipped with the engine loses its normal vehicular function. Therefore, some backup means is required to avoid such a situation.

In order to meet such requirements, a fuel-injection control system, as illustrated in FIG. 1, was proposed which is of a multiple point type having an intake-air sensor. In FIG. 1, there is schematically shown the general arrangement of an automotive internal combustion engine which includes an engine proper 1, an intake-air sensor 2 in the form of a flow-rate sensor for detecting the amount or flow rate of intake air sucked into the engine proper 1, a plurality of fuel injection valves 3*a* through 3*d* disposed in an intake passage 6 at a location downstream of a throttle valve 7, an engine RPM sensor 4 adapted to pick up engine revolution signals for generating an output signal representative of the RPMs of the engine proper 1, a temperature sensor 5 adapted to generate an output signal representative of the temperature of an engine coolant 16, a throttle valve 7 adapted to regulate the amount or flow rate of intake air sucked into the engine proper 1, a throttle-opening sensor 8 adapted to generate an output signal representative of the opening degree of the throttle valve 7, the throttle-opening sensor 8 being formed, for example, of a variable resistor and adapted to be used for correcting the amount of fuel injected from the injection valves 3*a* through 3*d* during acceleration or engine operation with the throttle valve 7 fully opened, a bypass conduit 9 for connecting between an upstream portion and a downstream portion of the intake passage 6 with respect to the throttle valve 7 for bypassing a part of intake air in the intake passage 6 across the throttle valve 7, a bypass valve 10 disposed in the bypass conduit 9 for controlling the flow rate of intake air flowing therethrough, a control unit 11 including an input interface 100, a microprocessor 101, a ROM 102, a RAM 103 and an output interface 104, the control unit 11 being adapted to receive output signals from the intake-air sensor 2, the engine RPM sensor 4, the temperature sensor 5, and the throttle-opening sensor 8 for controlling the operations of the fuel injection valves 3*a* through 3*d* in an appropriate manner, and a thermo-element 15 adapted to control the operation of the bypass valve 10 in accordance with the temperature of the engine coolant 16.

The operation of the above-described fuel-injection control system is well known in the art and hence only the important points will be briefly described in the following. First, the output signal of the intake-air sensor 2 representative of the detected amount of intake air sucked into the engine proper 1, the output pulse of the engine RPM sensor 4 representative of the detected engine RPMs, and the output signal of the temperature sensor 5 representative of the operating temperature of the engine proper 1 are input, as input information, to the input interface 100 of the control unit 11. Then, the microprocessor 101 calculates a pulse width and a pulse cycle to be fed to the fuel injection valves 3*a* through 3*d* in accordance with the operation processing program stored in the ROM 102, and the pulse width and the pulse cycle thus calculated are amplified by the output interface 104 and fed to the respective fuel injection valves 3*a* through 3*d* so as to operate these valves in an appropriate manner. Though not illustrated, the fuel injection valves 3*a* through 3*d* are supplied with pressurized fuel by a fuel pressurizing means (not shown). The flow-rate-type intake-air sensor 2 is generally of a vane type, a hot wire type, or a Karman type, but in place of such a flow-rate sensor, a pressure sensor may be employed which serves to detect the pressure of intake air sucked into the engine proper 1.

With the above fuel-injection control system, however, the engine will become inoperative should the intake-air sensor 2 fail. To avoid such a situation, various backup measures have been proposed. According to the most popular one of these backup measures, different fixed pulse widths are set for driving the fuel injection valves 3*a* through 3*d* at the time of the idling operation and the non-idling operation of the engine, respectively. In this measure, the actual air/fuel ratio of a mixture fed to the engine proper 1 becomes a desired value only at a certain opening degree of the throttle valve 7, but in almost all the remaining opening range of the throttle valve 7, the air/fuel ratio becomes too rich or lean, thus substantially impairing the operational performance of the engine.

In order to compensate for the above defect, an improved measure has recently been taken in which the amount of fuel to be injected into the engine proper 1 is controlled by the use of the output signal of the throttle-opening sensor 8 representative of the opening degree of the throttle valve 7 and the output signal of the engine RPM sensor 4 representative of the engine RPMs. The operation of this fuel injection control system will now be described with reference to a flow chart illustrated in FIG. 2. In this figure, at step 100, it is determined whether or not the intake-air sensor 2 has failed. This process differs according to the type of intake-air sensor 2 employed. For example, in case of a hot-wire type sensor, the characteristic of the output voltage with respect to the amount of intake air is represented by a curve (i.e., a 4th-power-root curve) shown in FIG. 4, and the output voltage (V) actually used is in the range from $V_1$ to $V_2$ so that, if $V_1 > V > V_2$, it can be determined that the sensor 2 is in a failed state. On the other hand, in case of a Karman type sensor, the frequency of the sensor output is in direct proportion to the intake-air amount, as illustrated in FIG. 5, and the output frequency f actually used is in the range from $f_1$ to $f_2$ so that, if $f_1 > f > f_2$, it can be determined that the sensor 2 is in a failed state. In another measure, the output range of the intake-air sensor 2 is predetermined in accordance with the opening degree of the throttle valve 7 and the RPMs of the engine so that, if the sensor output is out of the predetermined range, it is determined that the sensor 2 has failed. If the sensor 2 is determined to be normal as a result of step 100 by any one of the above-described measures, normal operation processing is effected at step 101. On the other hand, if the sensor 2 is determined to have failed, the output signal of the throttle-opening sensor 8 representative of the detected opening degree ($\theta$) of the throttle valve 7 is read out at step 102, and the output signal of the engine RPM sensor 4 representative of the detected engine RPMs (Ne) is then read out at step 103. Subsequently, at step 104, a basic pulse width ($\tau_0$) for driving the fuel injection valves 3*a* through 3*d* is determined in accordance with the detected throttle opening ($\theta$) and the detected engine RPMs (Ne). The basic pulse width ($\tau_0$) is prestored, as a two-dimensional map corresponding to the engine RPMs (Ne) and the throttle opening ($\theta$), in the ROM 102 as illustrated in FIG. 3. Specifically, the actual basic pulse width ($\tau_0$) is determined through an interpolating operation or calculation by using plural points which are read out from the two-dimensional map, and which are the nearest to the actual ($\theta$) and (Ne) detected. At step 105, the basic pulse width ($\tau_0$) thus obtained is corrected by a correction coefficient (Kc) which is determined on the basis of the output signal from the temperature sensor 5 and a fuel-correction signal issued upon acceleration or deceleration of the engine. Accordingly, by repeating the above-described operations, the amount of fuel injected from the fuel injectors 3*a* through 3*d* into the engine proper 1 can be controlled to an appropriate level in accordance with the opening degree of the throttle valve 7 even if the intake-air sensor 2 has failed, thereby enabling the backup operation of the engine.

However, the above-described conventional fuel-injection control system has the following problems. Specifically, the pulse width of the fuel injection valves 3*a* through 3*d* for controlling the air/fuel ratio of the mixture is determined from the opening degree of the throttle valve 7 and the engine RPMs, so that, when the opening degree of the bypass valve 10 in the bypass conduit 9 is varied during the fast-idling operation (warm-up operation) of the engine by the thermo-element 15, the stroke of which changes in response to the temperature of the engine coolant 16, the amount of intake air actually sucked into the engine proper 1 is equal to the sum of the amount of intake air flowing through the main intake passage 6, regulated by the throttle valve 7, and the amount of intake air flowing through the bypass conduit 9, regulated by the bypass valve 10. For this reason, the opening degree of the throttle valve 7 does not correspond to the actual amount of intake air, and hence there will be a great error in the air/fuel ratio of the mixture, thus impairing the proper operation of the engine.

SUMMARY OF THE INVENTION

The present invention is intended to obviate the above-described problems of the prior art, and has for its object the provision of a novel and improved fuel-injection control system for an internal combustion engine which is capable of ensuring the stable and proper backup operation of the engine in case of a failure of the intake-air sensor without suffering from any substantial influence of the amount of intake air flowing through the bypass conduit.

In order to achieve the above object, according to the present invention, there is provided a fuel-injection control system for an internal combustion engine in which air is sucked into an engine proper by way of an intake passage through a throttle valve disposed therein, and in which fuel is injected into the intake passage through fuel injection means so as to admix with the intake air to form a combustible mixture, there being a bypass conduit connecting between an upstream portion and downstream portion of the intake passage with respect to the throttle valve for bypassing a part of the intake air across the throttle valve with a bypass valve disposed in the bypass conduit for controlling the flow of intake air passing therethrough, the fuel-injection control system comprising:

an intake-air sensor for detecting a certain factor of the intake air sucked into the engine proper;

a throttle-opening sensor adapted to generate an output signal representative of the opening degree of the throttle valve;

a temperature sensor adapted to generate an output signal representative of the temperature of an engine coolant;

an engine RPM sensor adapted to generate an output signal representative of the RPMs of the engine proper; and a control unit adapted to receive output signals of the sensors for controlling the operations of the fuel injection means on the basis of the information on engine operating conditions obtained from the sensors in a manner such that if the intake-air sensor fails, the amount of fuel to be injected from the fuel injection means is determined on the basis of the opening degree of the throttle valve detected by the throttle-opening sensor, the temperature of the engine coolant detected by the temperature sensor, and the RPMs of the engine proper detected by the engine RPM sensor.

Preferably, the control unit comprises:

an input interface electrically connected to the sensors so as to receive the output signals thereof;

a failure-detecting means adapted to receive, through the input interface, the output signal of the intake-air sensor for detecting whether or not the intake-air sensor has failed;

a throttle-opening detecting means adapted to receive, through the input interface, the output signal of the throttle-opening sensor for detecting the opening degree of the throttle valve;

an engine RPM detecting means adapted to receive, through the input interface, the output signal of the engine RPM sensor for detecting the engine RPMs;

an engine-coolant temperature detecting means adapted to receive, through the input interface, the output signal of the temperature sensor for detecting the temperature of the engine coolant;

correction means adapted to detect the opening degree of the bypass valve for correcting the detected opening degree of the throttle valve based on the detected bypass-valve opening degree so as to reflect the actual amount of intake air sucked into the engine proper through the intake passage and the bypass passage;

a basic-pulse-width determining means for determining a basic pulse width from the corrected value of the throttle-valve opening degree and the detected engine RPMs;

an injection-pulse-width determining means for correcting the basic pulse width by means of a correction coefficient which is determined by engine operating conditions such as the engine temperature, acceleration, deceleration and the like;

a valve controlling means for controlling the operation of the fuel injection means in a predetermined normal manner on the basis of the output signals of the failure-detecting means and the injection-pulse-width determining means; and an output interface electrically connected to the fuel injection means for controlling the operations of the fuel injection valves on the basis of the output signal of the valve controlling means.

The correction means may comprise:

a bypass-valve-opening detecting means having a ROM storing a characteristic curve and adapted to receive the output signal of the engine-coolant-temperature detecting means for detecting the opening degree of the bypass valve from the detected engine-coolant temperature by the use of the characteristic curve stored in the ROM; and a throttle-opening correcting means adapted to receive the output signal of the throttle-opening detecting means for correcting the detected opening degree of the throttle valve by means of a formula ($\theta_a=\theta+a\times\theta_b$, where $\theta_a$ is a corrected value of the opening degree of the throttle valve; $\theta$ is the detected opening degree of the throttle valve; $\theta_b$ is the detected opening degree of the bypass valve; and a is a constant which is determined by the diameter of the bypass conduit, the configuration of the bypass valve and the like).

The above and other objects, features and advantages of the present invention will become apparent from the following detailed description of a presently preferred embodiment of the invention when taken in conjunction with the accompanying drawings.

DESCRIPTION OF THE PREFERRED EMBODIMENT

Figure 1:
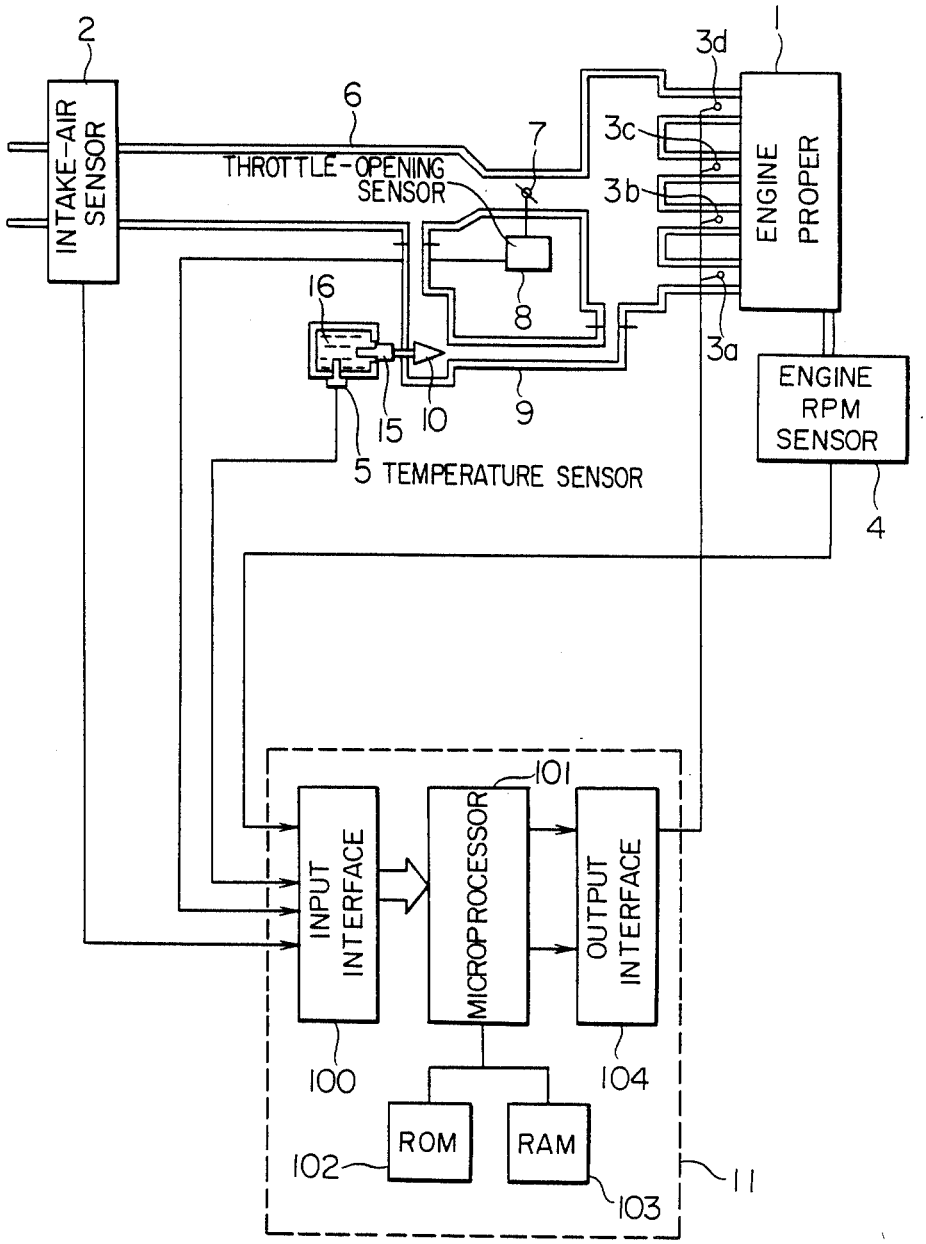
FIG. 1 is a schematic view showing the general arrangement of an internal combustion engine for an automotive vehicle equipped with a conventional fuel-injection control system.

The present invention will now be described with reference to a presently preferred embodiment thereof as illustrated in the drawings. In the following, description will be made of the case in which a fuel-injection control system 211 of the present invention is applied to the internal combustion engine illustrated in FIG. 1.

Figure 6:
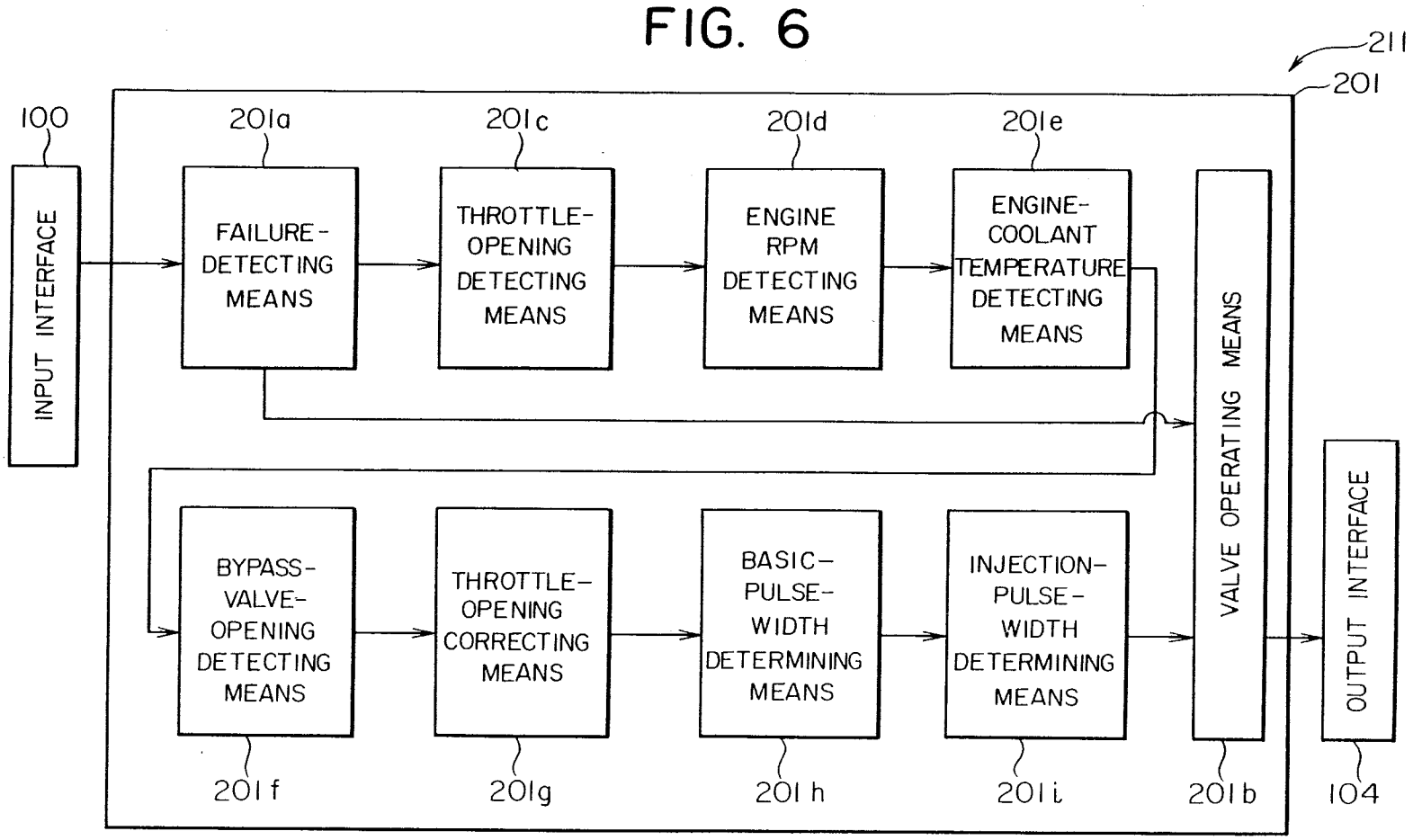
FIG. 6 is a schematic view showing the construction of a control unit of a fuel-injection control system in accordance with the present invention, the system being applicable to the internal combustion engine illustrated in FIG. 1.

The fuel-injection control system of the present invention differs from the prior art system illustrated in FIG. 1 in the construction of the control unit. Specifically, as shown in FIG. 6, the control unit of the invention, which is generally designated by reference numeral 211, and which is adapted to be used with the fuel-injection control system illustrated in FIG. 1, includes an input interface 100 electrically connected to an intake-air sensor 2 in the form of a flow-rate sensor or a pressure sensor, an engine RPM sensor 4, a temperature sensor 5 and a throttle-opening sensor 8 (see FIG. 1) so as to receive the output signals thereof, a microprocessor 201, and an output interface 104 electrically connected to the fuel injection valves 3*a* through 3*d* for controlling the operations of the fuel injection valves 3*a* through 3*d* based on the output signals of the microprocessor 201.

Figure 3:
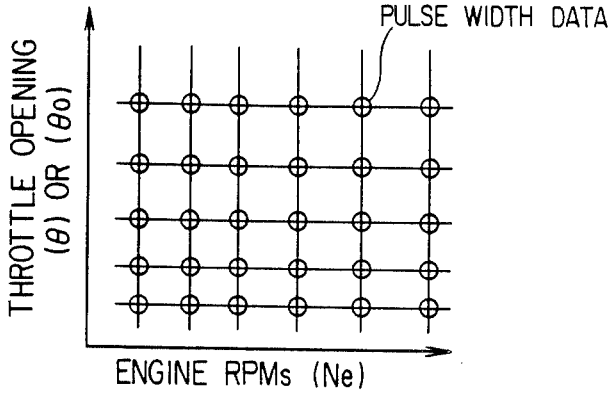
FIG. 3 is a view showing a data map for use with the backup operation of the conventional fuel-injection control system.
Figure 4:
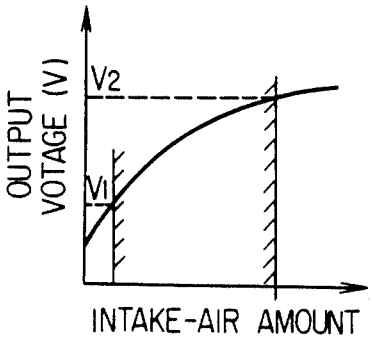
FIG. 4 is a view showing the characteristics of an intake-air sensor illustrated in FIG. 1.
Figure 5:
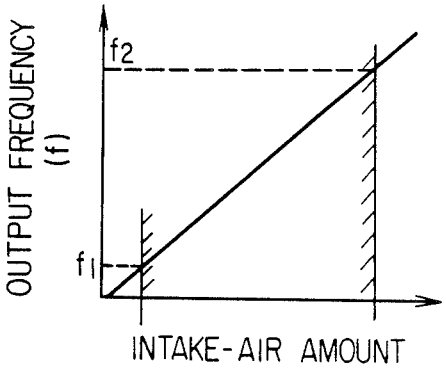
FIG. 5 is a view showing the characteristics of another intake-air sensor usable in place of the intake air sensor of FIG. 1.
Figure 8:
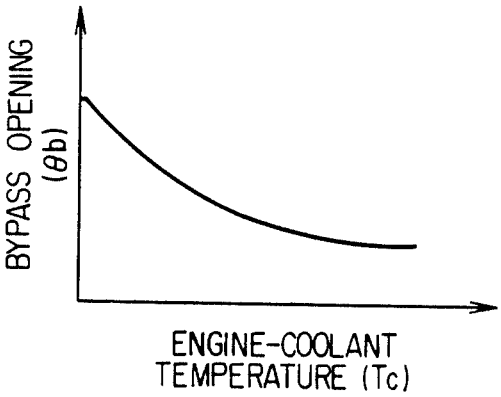
FIG. 8 is a characteristic view showing a relationship between the temperature of an engine coolant and the opening degree of a bypass valve in accordance with the present invention.

The microprocessor 201 comprises a failure-detecting means 201*a* adapted to receive, through the input interface 100, the output signal of the intake-air sensor 2 for detecting a failure of the intake-air sensor 2, a throttle-opening detecting means 201*c* adapted to receive, through the input interface 100, the output signal of the throttle-opening sensor 8 for detecting the opening degree of the throttle valve 7, an engine RPM detecting means 201*d* adapted to receive, through the input interface 100, the output signal of the engine RPM sensor 4 for detecting the engine RPMs, an engine-coolant temperature detecting means 201*e* adapted to receive, through the input interface 100, the output signal of the temperature sensor 5 for detecting the temperature (Tc) of an engine coolant 16, a bypass-valve-opening detecting means 201*f* having a ROM storing a characteristic curve as illustrated in FIG. 8 and adapted to receive the output signal of the engine-coolant-temperature detecting means 201*e* for detecting the opening degree ($\theta_b$) of the bypass valve 10 from the detected engine-coolant temperature (Tc) by the use of the characteristic curve stored in the ROM, a throttle-opening correcting means 201*g* adapted to receive the output of the throttle-opening detecting means 201*c* for correcting the detected opening degree ($\theta_b$) of the throttle valve 7 by means of a formula ($\theta_a=\theta+a\times\theta_b$, where $\theta_a$ is a corrected value of the opening degree of the throttle valve 7; $\theta$ is the detected opening degree of the throttle valve 7; $\theta_b$ is the detected opening degree of the bypass valve 10; and a is a constant which is determined by the diameter of the bypass conduit 9, the configuration of the bypass valve 10 and the like), a basic-pulse-width determining means 201*h* for determining a basic pulse width ($\tau_0$) from the corrected value ($\theta_a$) of the throttle-valve opening degree ($\theta$) and the detected engine RPMs (Ne) by the use of a map showing injection-valve-driving pulse widths preset in accordance with the specific engine characteristics as illustrated in FIG. 3, and an injection-pulse-width determining means 201*i* for correcting the basic pulse width ($\tau_0$) by means of a correction coefficient (Kc) which is determined by engine operating conditions such as the engine temperature, acceleration, deceleration and the like, and a valve operating means 201*i* adapted to receive the output signals of the failure-detecting means 201*a* and the injection-pulse-width determining means 201*i* for controlling the operations of the fuel injection valves 3*a* through 3*d* in a predetermined normal manner.

Figure 7:
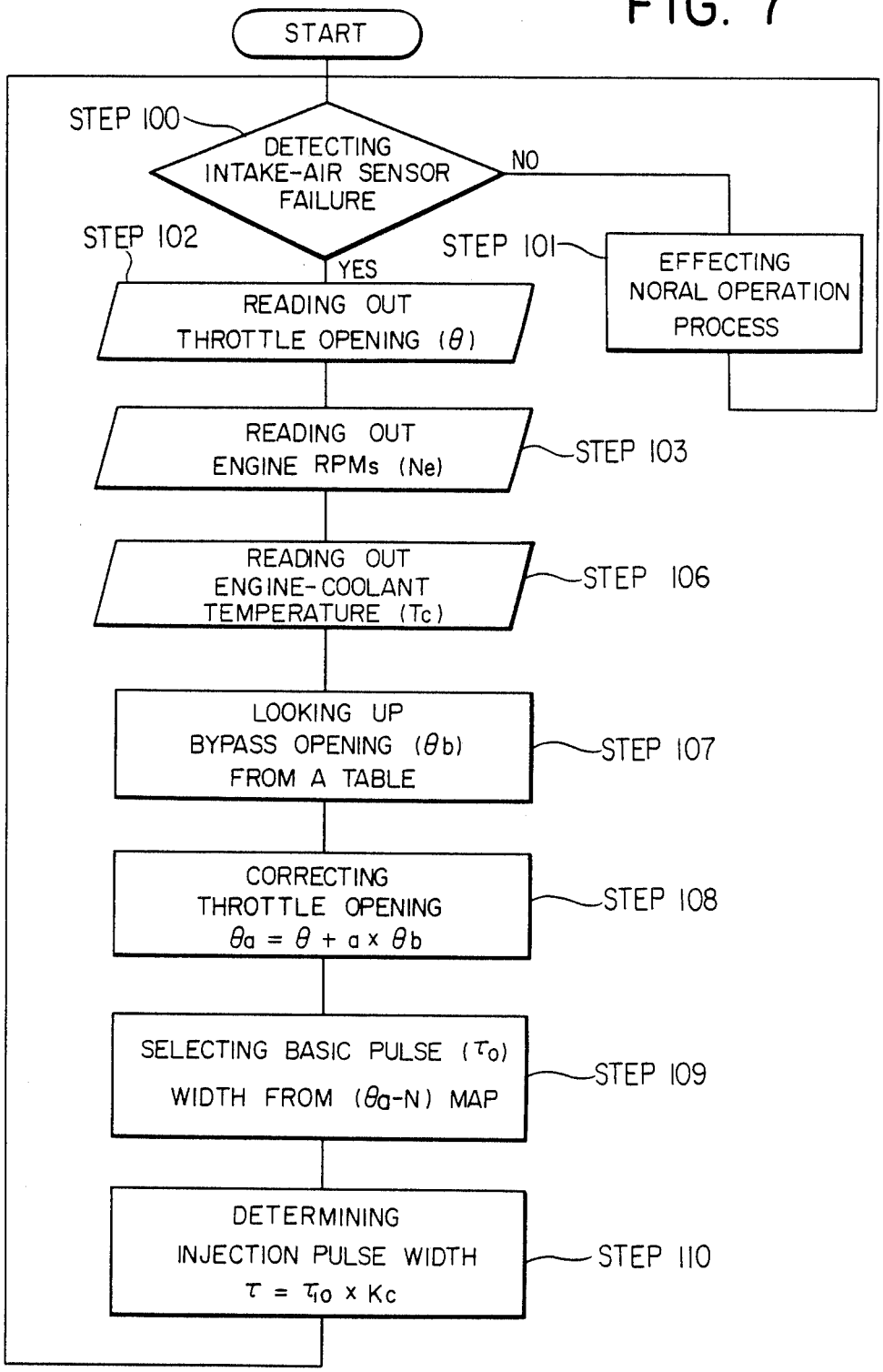
FIG. 7 is a flow chart showing the operating process of the fuel-injection control system of the present invention.

The control unit 211 as constructed above operates in a manner as illustrated in the flow chart of FIG. 7. Specifically, after the engine is started, the failure-detecting means 201*a* detects, at step 100, whether or not the intake-air sensor 2 has failed, and if not, the control unit 211 of the fuel-injection control system acts to control the operations of the fuel injection valves 3*a* through 3*d* in a normal way.

Figure 2:
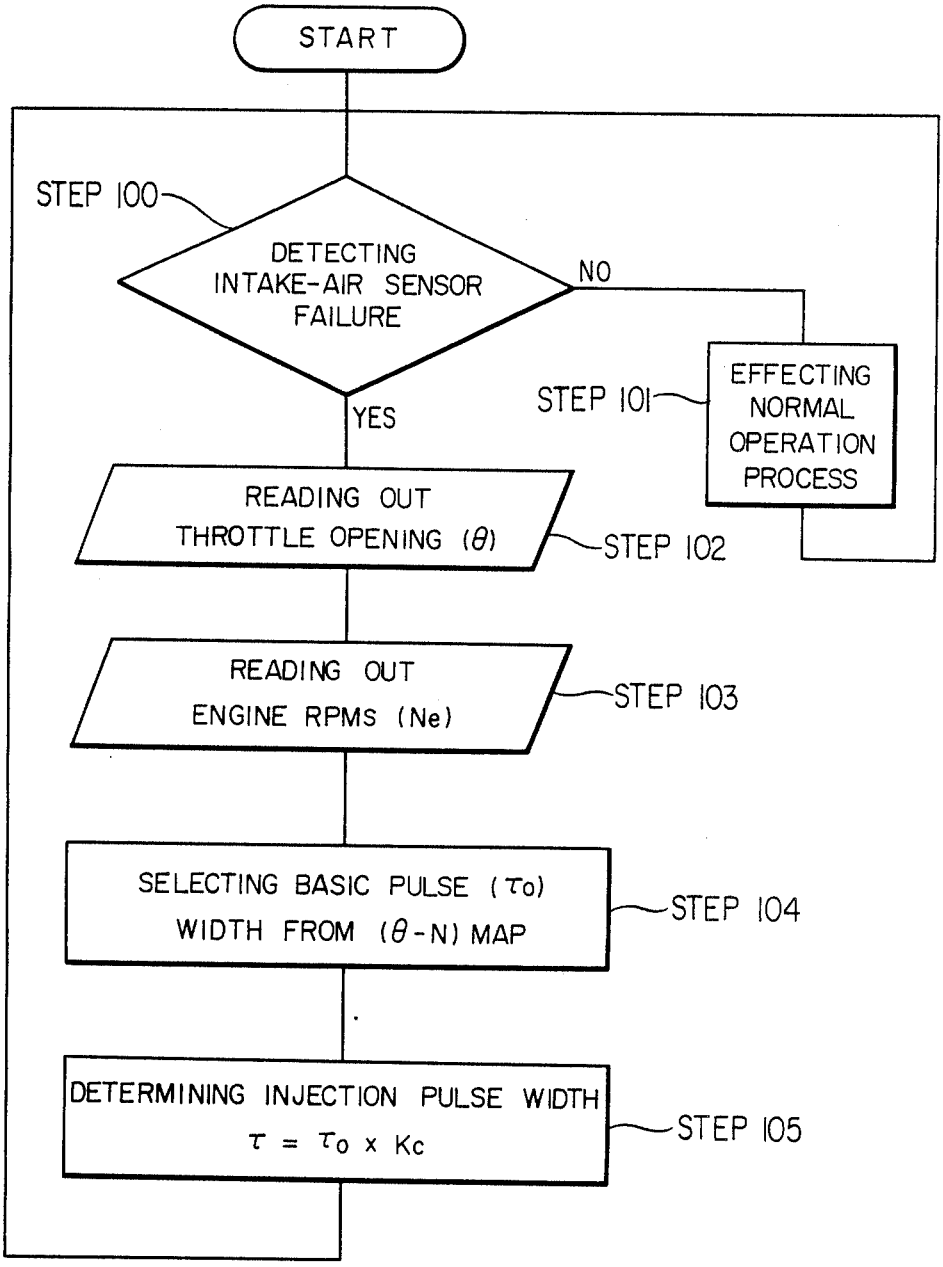
FIG. 2 is a flow chart showing the operating process of the convention fuel-injection control system illustrated in FIG. 1.

On the other hand, if the failure-detecting means 201*a* detects a failure of the intake-air sensor 2, the throttle-opening detecting means 201*c* detects the opening degree ($\theta_b$) of the throttle valve 7 at step 102, and the engine RPM detecting means 201*d* detects the RPMs (Ne) of the engine at step 103 similar to the prior art fuel-injection control process illustrated in the flow chart of FIG. 2. Further, at step 106 in FIG. 7, the engine-coolant temperature detecting means 201*e* detects the temperature (Tc) of the engine coolant, and at step 107, the bypass-valve-opening detecting means 201*f* looks up an appropriate opening degree ($\theta_b$) of the bypass valve 10 from the characteristic curve illustrated in FIG. 8, which is preset in the ROM (not shown) FIG. 8, and then at step 108, the throttle-opening correcting means 201*g* calculates a corrected value ($\theta_a$) of the opening degree ($\theta$) of the throttle valve 7 on the basis of the above-mentioned formula ($\theta_a=\theta+a\times\theta_b$). In this regard, it is to be noted that the flow rate of intake air flowing through the bypass conduit 9 is varied due to a pressure differential in the intake passage 6 across the throttle valve 7 which changes in accordance with the opening degree of the throttle valve 7 and the engine RPMs, and therefore, accuracy in such a correction will be further improved by correcting the constant a in the above formula by means of the detected opening degree ($\theta$) of the throttle valve 7 and the detected engine RPMs (Ne). Subsequently, at step 109, the basic-pulse-width determining means 201*h* selects an appropriate basic pulse width ($\tau_0$) from the corrected throttle opening value ($\theta_a$) and the detected engine RPMs (Ne) on the injection-pulse-width data map as illustrated in FIG. 3, and actually, such a basic pulse width ($\tau_0$) is, of course, calculated by an interpolating operation. At step 110, the injection-pulse-width determining means 201*i* corrects the basic pulse width ($\tau_0$) thus obtained by means of the correction coefficient (Kc) which is determined by engine operating conditions such as, for example, engine temperature, acceleration, deceleration, and the like. Finally, at step 101, the valve operating means 201*b* controls, through the output interface 104, the operations of the fuel injection valves 3*a* through 3*d* in a normal manner on the basis of the output signal from the injection-pulse-width determining means 201*i*.

In this manner, in case of a failure of the intake-air sensor 2, the actual amounts of fuel injected into the engine proper 1 are determined on the basis of the information obtained from the throttle-opening sensor 8, the engine RPM sensor 4 and the temperature sensor 5. Thus, the amount of auxiliary intake air flowing through the bypass conduit 9 is determined from the temperature of the engine coolant 16 detected by the temperature sensor 5 so as to correct the detected opening degree of the throttle valve 7, whereby there will be no substantial variation in the air/fuel ratio of the mixture which would otherwise be caused due to changes in the amount of auxiliary intake air passing through the bypass conduit 9. Accordingly, it is possible to provide a stable air/fuel ratio of the mixture under any operating conditions of the engine, thus enabling the proper operation of the engine without any difficulty even when the intake-air sensor 2 has failed.

Although in the foregoing description, a plurality of injection valves 3*a* through 3*d*, disposed in the intake passage 6 at locations downstream of the throttle valve 7, are employed for respective engine cylinders of the engine proper 1 (see FIG. 1), the present invention can be likewise applied to an internal combustion engine in which a single fuel injection valve is provided at a location upstream or downstream of the throttle valve 7 for plural engine cylinders.

What is claimed is:

1. In an internal combustion engine in which air is sucked into an engine proper by way of an intake passage through a throttle valve disposed therein, and in which fuel is injected into said intake passage through fuel injection means so as to admix with the intake air to form a combustible mxiture, there being a bypass conduit connecting between an upstream portion and a downstream portion of said intake passage with respect to said throttle valve for bypassing a part of the intake air across said throttle valve with a bypass valve disposed in said bypass conduit for controlling the flow of intake air passing therethrough, a fuel-injection control system comprising:

an intake-air sensor for detecting a certain factor of the intake air sucked into said engine proper;

a throttle-opening sensor adapted to generate an output signal representative of the opening degree of said throttle valve;

a temperature sensor adapted to generate an output signal representative of the temperature of an engine coolant;

an engine RPM sensor adapted to generate an output signal representative of the RPMs of said engine proper; and a control unit adapted to receive output signals of said sensors for controlling the operations of said fuel injection means on the basis of the information on engine operating conditions obtained from said sensors in a manner such that if said intake-air sensor fails, the amount of fuel to be injected from said fuel injected means is determined on the basis of the opening degree of said throttle valve detected by said throttle-opening sensor, the position of the bypass valve as sensed by the temperature of said engine coolant detected by said temperature sensor, and the RPMs of said engine proper detected by said engine sensor.

2. A fuel-injection control system in an internal combustion engine as set forth in claim 1 wherein said control unit comprises:

an input interface electrically connected to said sensors so as to receive the output signals thereof;

a failure-detecting means adapted to receive, through said input interface, the output signal of said intake-air sensor for detecting whether or not said intake-air sensor has failed;

a throttle-opening detecting means adapted to receive, through said input interface, the output signal of said throttle-opening sensor for detecting the opening degree of said throttle valve;

an engine RPM detecting means adapted to receive, through said input interface, the output signal of said engine RPM sensor for detecting the engine RPMs;

an engine-coolant temperature detecting means adapted to receive, through said input interface, the output signal of said temperature sensor for detecting the temperature of said engine coolant;

correction means responsive to the engine-coolant temperature detecting means and adapted to detect the opening degree of said bypass valve for correcting the detected opening degree of said throttle valve based on the detected bypass-valve opening degree so as to reflect the actual amount of intake air sucked into said engine proper through said intake passage and said bypass passage;

a basic-pulse-width determining means for determining a basic pulse width from the corrected value of the throttle-valve opening degree and the detected engine RPMs;

an injection-pulse-width determining means for correcting the basic pulse width by means of a correction coefficient which is determined by engine operating conditions such as the engine temperature, acceleration, deceleration and the like;

a valve controlling means for controlling the operation of said fuel injection means in a predetermined normal manner on the basis of the output signals of said failure-detecting means and said injection-pulse-width determining means; and an output interface electrically connected to said fuel injection means for controlling the operations of said fuel injection valves on the basis of the output signal of said valve controlling means.

3. A fuel-injection control system in an internal combustion engine as set forth in claim 2 wherein said correction means comprises:

a bypass-valve-opening detecting means having a ROM storing a characteristic curve and adapted to receive the output signal of said engine-coolant-temperature detecting means for detecting the opening degree of said bypass valve from the detected engine-coolant temperature by the use of the characteristic curve stored in said ROM; and a throttle-opening correcting means adapted to receive the output signal of said throttle-opening detecting means for correcting the detected opening degree of said throttle valve by means of a formula ($\theta_a=\theta+a\times\theta_b$, where $\theta_a$ is a corrected value of the opening degree of said throttle valve; $\theta$ is the detected opening degree of said throttle valve; $\theta_b$ is the detected opening degree of said bypass valve; and a is a constant which is determined by the diameter of said bypass conduit, the configuration of the bypass valve and the like).

4. A fuel-injection control system in an internal combustion engine as set forth in claim 2 wherein said basic-pulse-width determining means determines the basic pulse width from the corrected value of the throttle-valve opening degree and the detected engine RPMs by the use of a map showing injection-valve-driving pulse widths preset in accordance with specific engine characteristics.

5. A fuel-injection control system in an internal combustion engine as set forth in claim 1 wherein said intake-air sensor comprises a pressure sensor adapted to detect the pressure of intake air flowing through said intake passage.

* * * * *